US010082050B2

(12) United States Patent
Nielsen et al.

(10) Patent No.: US 10,082,050 B2
(45) Date of Patent: Sep. 25, 2018

(54) ANTI-ROTATION DEVICE FOR LIFTER

(71) Applicant: Eaton Corporation, Cleveland, OH (US)

(72) Inventors: Douglas John Nielsen, Marshall, MI (US); Anthony Leon Spoor, Union City, MI (US); Robert D. Hogan, Marshall, MI (US)

(73) Assignee: Eaton Intelligent Power Limited, Dublin (IE)

( * ) Notice: Subject to any disclaimer, the term of this patent is extended or adjusted under 35 U.S.C. 154(b) by 30 days.

(21) Appl. No.: 15/263,570

(22) Filed: Sep. 13, 2016

(65) Prior Publication Data

US 2017/0074125 A1 Mar. 16, 2017

Related U.S. Application Data

(60) Provisional application No. 62/219,268, filed on Sep. 16, 2015.

(51) Int. Cl.
*F01L 1/14* (2006.01)
*F01L 1/18* (2006.01)

(52) U.S. Cl.
CPC ..... *F01L 1/146* (2013.01); *F01L 1/14* (2013.01); *F01L 1/181* (2013.01); *F01L 2105/00* (2013.01); *F01L 2107/00* (2013.01); *F01L 2810/02* (2013.01)

(58) Field of Classification Search
CPC ... F01L 1/146; F01L 1/181; F01L 1/14; F01L 2107/00; F01L 2810/02
See application file for complete search history.

(56) References Cited

U.S. PATENT DOCUMENTS

| | | | |
|---|---|---|---|
| 4,089,234 | A | 5/1978 | Henson et al. |
| 5,022,356 | A | 6/1991 | Morel, Jr. et al. |
| 6,357,407 | B2 | 3/2002 | Brothers |
| 6,932,041 | B1 | 8/2005 | Riley |
| 7,121,244 | B2 | 10/2006 | Roe et al. |

(Continued)

FOREIGN PATENT DOCUMENTS

| | | | | |
|---|---|---|---|---|
| DE | 19600852 | A1 * | 7/1997 | ..... F01L 1/143 |
| DE | 102012217801 | A1 * | 4/2014 | ..... F04B 53/22 |

OTHER PUBLICATIONS

Abstract of above, DE 102012217801 dated Apr. 2014.*
Abstract of above, DE 19600852 dated Jul. 1997.*

*Primary Examiner* — Zelalem Eshete
(74) *Attorney, Agent, or Firm* — Paul V. Keller

(57) ABSTRACT

An anti-rotation guide for a lifter in an overhead valve valvetrain. The anti-rotation guide includes a plug having two lobes connected through a neck region. A first lobe of the plug is held within a bore in the lifter. The bore forms an opening at the edge of the lifter through which the neck of the plug emerges. The bore in the lifter accommodates a first lobe of the plug that is wider than the opening in the edge of the lifter, whereby the plug is shaped to prevent its slipping from the lifter through the opening. The lifter reciprocates in a first bore in the cylinder head. The second lobe of the plug extends outward from the lifter into a second bore formed in the cylinder head and adjoining the first bore. The second lobe reciprocates in the second bore and limits rotation of the lifter.

20 Claims, 6 Drawing Sheets

(56) References Cited

U.S. PATENT DOCUMENTS

| | | | | |
|---|---|---|---|---|
| 8,464,678 | B1 * | 6/2013 | Iskenderian | F01L 1/146<br>123/90.33 |
| 2006/0016406 | A1 * | 1/2006 | Geyer | F01L 1/14<br>123/90.5 |

* cited by examiner

ANTI-ROTATION DEVICE FOR LIFTER

PRIORITY

The present application claim priority from US Provisional Application No. 62/219,268 filed Sep. 16, 2015.

FIELD

The present teachings relate to valvetrains, particularly anti-rotation guides for lifters used in overhead valve (OHV) valvetrains.

BACKGROUND

Some valvetrains include lifters that pass through a cylinder head to transmit force from a cam positioned under the cylinder head to a rocker arm position above the cylinder head. The lifter may include a roller follower that abuts and follows the cam and a cylindrical portion that reciprocates within a bore in the cylinder head.

An anti-rotation guide may be used to maintain proper orientation of the roller-follower with respect to the cam. Examples of anti-rotation guides include a framing member positioned above the cylinder head and a pin and groove arrangement within the cylinder head. These designs may not always be reliable over the life of an engine. There continues to be a long felt need for anti-rotation guides that are compact, easy to manufacture, and highly reliable.

SUMMARY

According to some aspects of the present teachings, an anti-rotation guide may be mounted to a lifter that is part of a valvetrain for an overhead valve (OHV) engine. The guide may have a profile that remains uniform over a portion of its length in a direction parallel to the lifter's axis. The profile may include a first region and a second region joined by a neck region. The first region may facilitate mounting the anti-rotation guide to the lifter. The second region extends via the neck region outward from the lifter. The first region may hold the anti-rotation guide to the lifter. The second region may fit within a guide channel formed in a cylinder head and maintain the orientation of the lifter as it reciprocates within the cylinder head. An anti-rotation guide according to these teachings may be securely held to the lifter, may reliably maintain orientation of the lifter, and have a low probability of interfering with reciprocation of the lifter.

In some of these teachings, the cylinder head includes first and second bores. The first and second bores may be parallel to the lifter axis and overlap to form an opening between them. The lifter may be mounted to reciprocate within the first bore while the second region of the anti-rotation guide reciprocates within the second bore, including a portion of the second bore that is outside of the first bore. The cylinder head with the aforementioned bores provide a simple solution to manufacturing an engine that uses a lifter with an anti-rotation guide according to the present teachings.

In some of these teachings, the first region of the anti-rotation guide may be mounted within a bore that is formed in the lifter itself. The bore in the lifter may be parallel to the lifter axis, extend partway through the length of the lifter, and intersect the edge of the lifter to form an opening in the edge of the lifter out of which the anti-rotation guide extends. The opening in the edge of the lifter may have a width less than the diameter of the bore in the lifter. This structure facilitates retention of the anti-rotation guide by the lifter.

According to some aspects of the present teachings, an engine includes a cylinder head in which first and second bores are formed. The first and second bores are parallel and overlap to form an opening between them. A cylindrical portion of a lifter of a valvetrain is threaded through the first bore. A bore is formed in the lifter. The bore in the lifter has an axis parallel to that of the cylindrical portion and intersects an edge of the cylindrical portion to form an opening in an edge of the lifter. A plug in the bore in the lifter has a protrusion extending through the opening in the edge of the lifter. The protrusion is positioned to reciprocate within the second bore in the cylinder head and limit rotation of the lifter.

In some of these teachings, the portion of the plug that is in the lifter has a greater width that the opening in the edge of the lifter. This may facilitate retention of the plug. In some of these teachings, the lifter has a greater width than the opening between the bores in the cylinder head. This may enhance functioning of the anti-rotation guide.

In some of these teachings, the plug is retained in the bore in the lifter by a C-clip. In some of these teachings, the C-clip is held within a groove in the lifter that is formed about the perimeter of the bore in the lifter. The bore in the lifter may have an end that terminates within the cylindrical portion of the lifter to form a relatively flat end surface. The flat end surface may create a more consistent length within which the anti-rotation guide may be held the C-clip. The plug may be securely held between the C-clip and the relatively flat end surface. The plug may have a bulge that extends outward between two ends of the C-clip. The bulge may limit rotation of the C-clip, further securing the mounting of the plug to the lifter and minimizing the chance of interference between the cylinder block and parts mounted to the lifter. A plug with the desired bulge may be readily manufactured by cold-forming. In some alternative teachings, the plug is held to the lifter by a set screw.

In some of these teachings, a groove is formed about the perimeter of the cylindrical portion of the lifter. The groove may provide an oil reservoir for maintaining lubrication of the lifter and the anti-rotation guide. In some of these teaching, the groove is at the height of the anti-rotation guide. An oil rifle may be formed in the cylinder block and let out on the first bore. In some of these teachings, the positioning of the oil rifle place it above the groove throughout the lifter's range of motion. This structure has been found to provide sufficient lubrication for the lifter and the anti-rotation guide while avoiding excessive oil consumption.

The primary purpose of this summary has been to present broad aspects of the present teachings in a simplified form to facilitate understanding of the present disclosure. This summary is not a comprehensive description of every aspect of the present teachings. Other aspects of the present teachings will be conveyed to one of ordinary skill in the art by the following detailed description together with the drawings.

BRIEF DESCRIPTION OF THE DRAWINGS

Spatially relative terms, such as "beneath," "below," "lower," "above," "upper" and the like, may be used herein to describe spatial relationships as illustrated in the figures. These relationships are independent from the orientation of any illustrated device in actual use.

DETAILED DESCRIPTION

Figure 1:
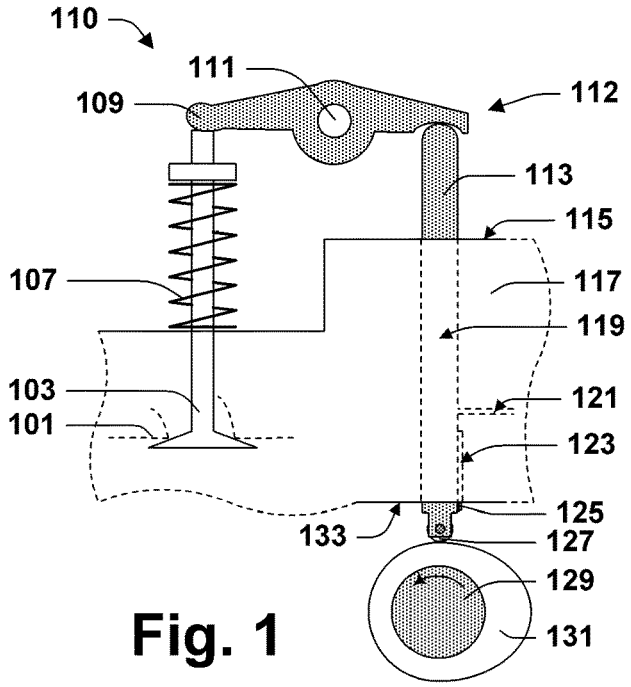
FIG. 1 illustrates part of an engine including a valvetrain having an anti-rotation guide according to some aspects of the present teachings.
Figure 2:
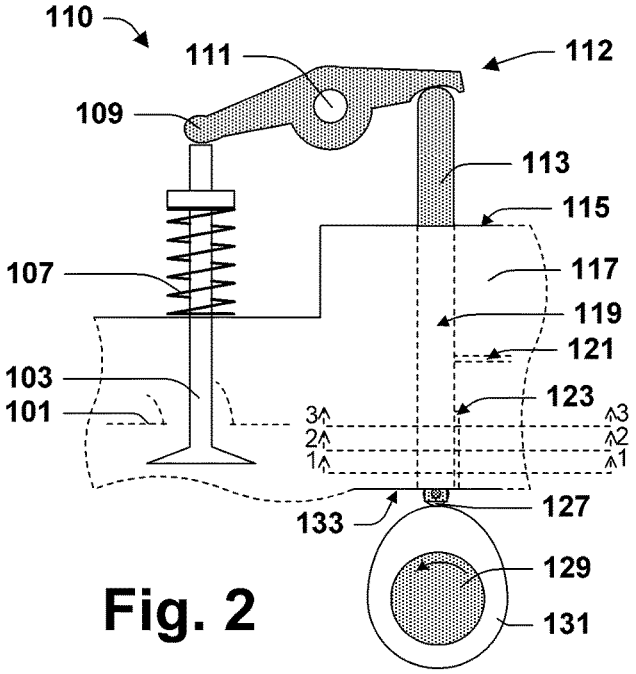
FIG. 2 illustrates the engine of FIG. 1 with the cam off base circle.

FIG. 1 illustrates a portion of an engine 110 that has an OHC valvetrain 112 according to some aspects of the present teachings. Engine 110 includes a cylinder head 117 having an upper surface 115 and a lower surface 133 (only parts of these structures are illustrated. The valvetrain 112 may include cam shaft 129, cam 131, lifter 113, rocker arm 109, rocker shaft 111, and valve 103. Valve 103 may control a port formed in cylinder head 117. Lifter 113 is threaded through cylinder head 117 and may include a cam follower 127. A cam follower 127 on lifter 113 may be biased against cam 131 by, for example, valve spring 107. As shown by FIG. 2, rotation of cam shaft 129 may result in cam 131 driving lifer 113 upward. Lifter 113 may then cause rocker arm 109 to pivot on rocker shaft 111 and descend onto valve 103, compressing valve spring 117 against upper surface 115 and lifting valve 109 off its seat 101 within cylinder head 117. The present teachings may be applicable to any engine type having a lifter 113 that reciprocates within a cylinder head 117 or the like. But in some of these teachings, lifter 113 is part of an overhead valve (OHV) valvetrain 112. In some of these teaching, lifter 113 includes a hydraulic lash adjuster (not shown).

Figure 3:
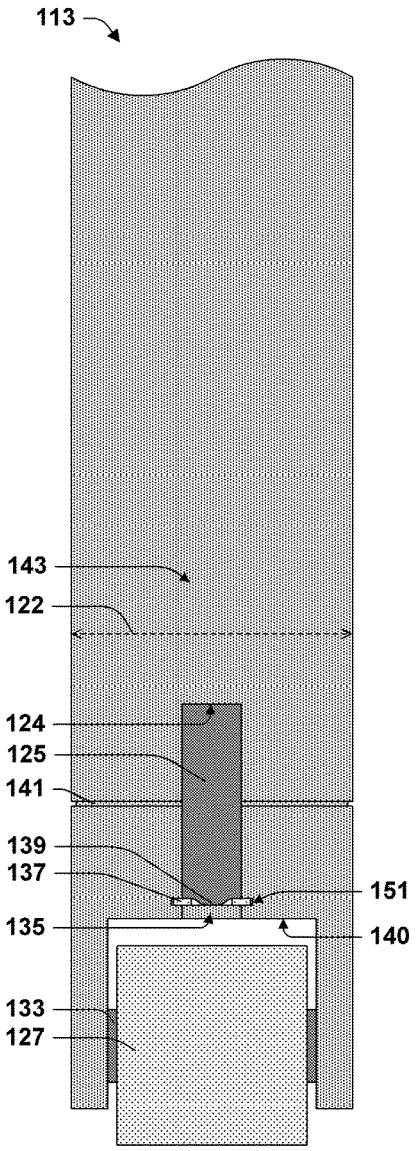
FIG. 3 illustrates a front view of the lower portion of a lifter according to some aspects of the present teachings.
Figure 4:
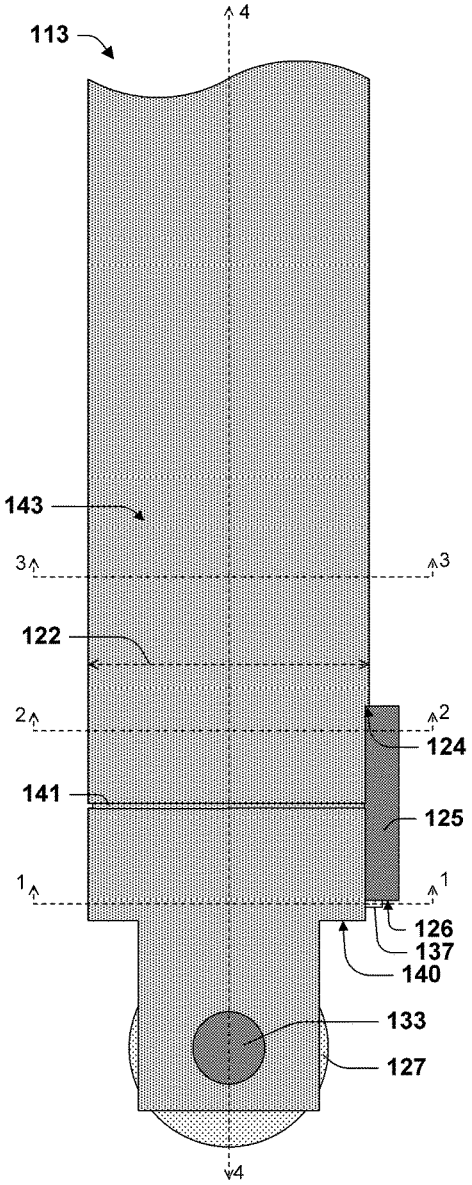
FIG. 4 illustrates a side view of the lifter of FIG. 2.

FIGS. 3 and 4 show a lower portion of lifter 113 in greater detail. Lifter 113 includes a cylindrical portion 143. As shown in these figures, in some of the present teachings cam follower 127 is mounted proximate a lower end of cylindrical portion 143. In some aspect of the present teachings, cam follower 127 is a roller follower. Cylindrical portion 143 may be positioned to reciprocate within a bore 119 formed in cylinder head 117. According to some aspects of the present teachings, an anti-rotation guide 125 is mounted to lifter 113.

Figure 5:
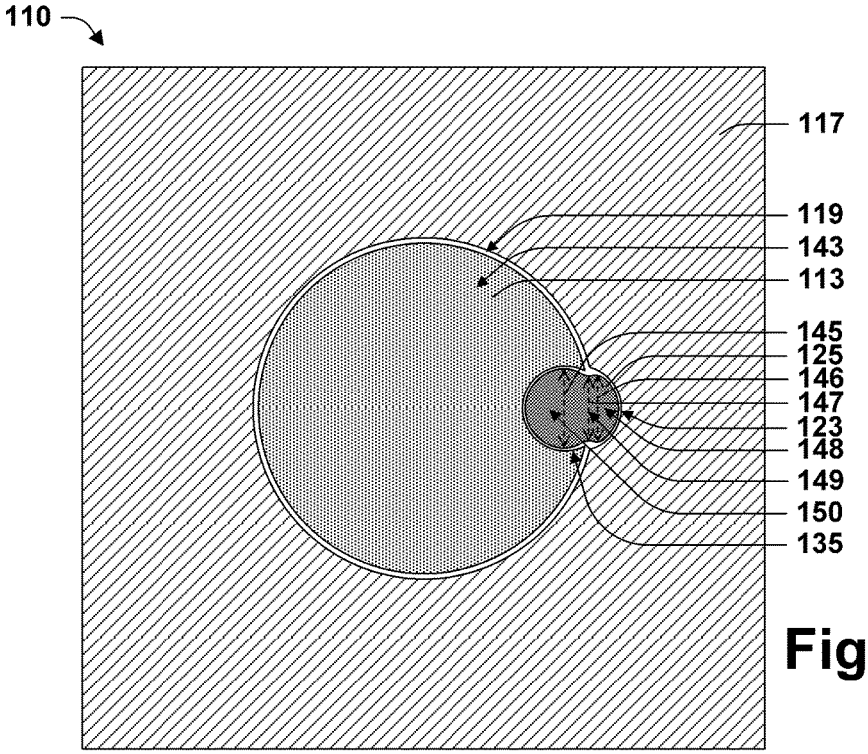
FIG. 5 illustrates a partial cross-section of the engine of FIG. 1 taken along the line 2-2.
Figure 6:
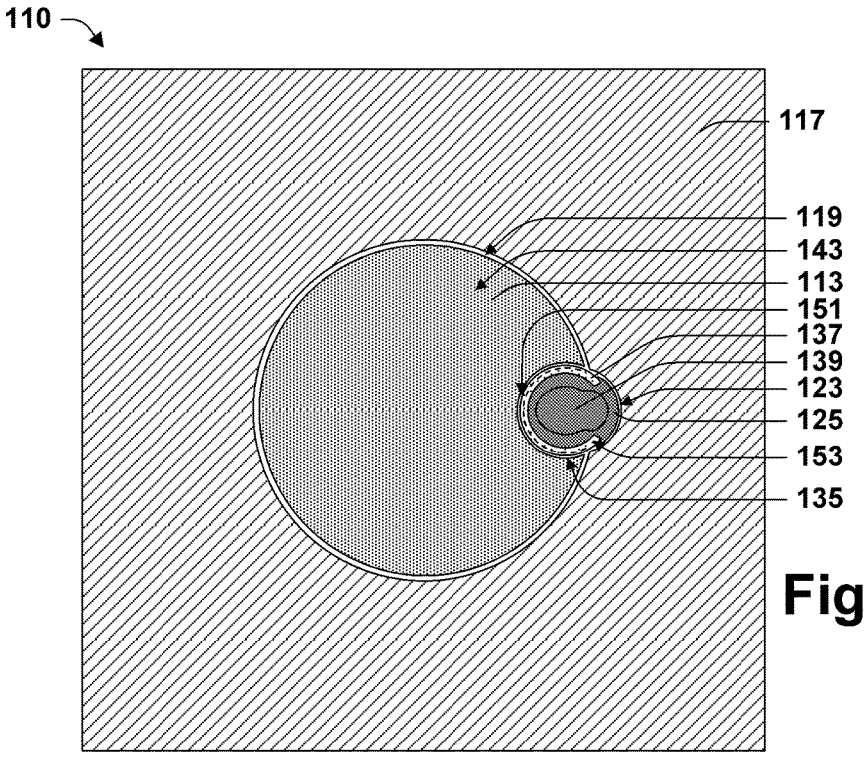
FIG. 6 illustrates a partial cross-section of the engine of FIG. 1 taken along the line 1-1.
Figure 7:
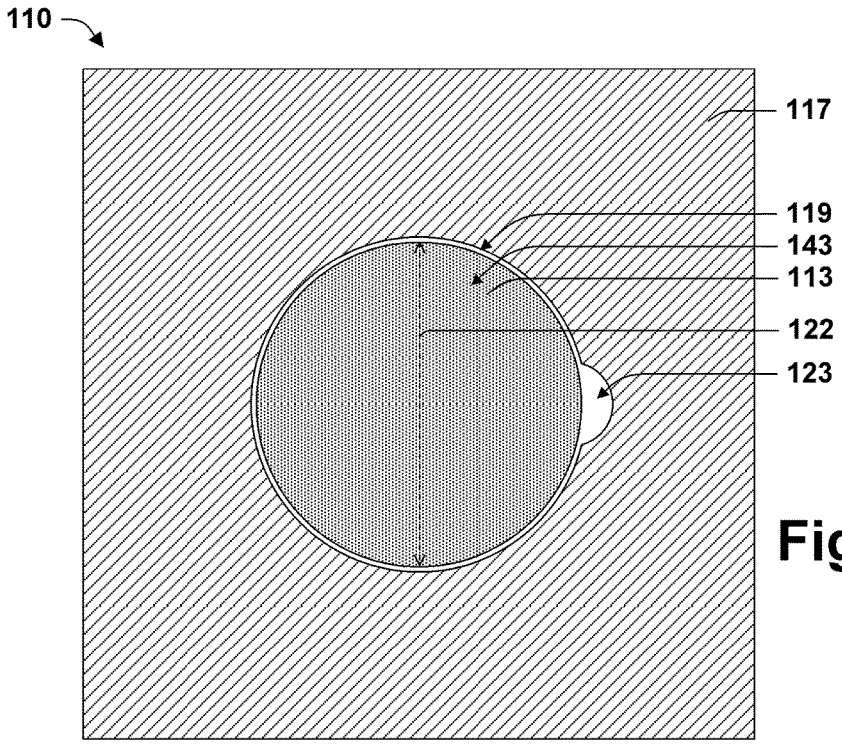
FIG. 7 illustrates a partial cross-section of the engine of FIG. 1 taken along the line 3-3.
Figure 8:
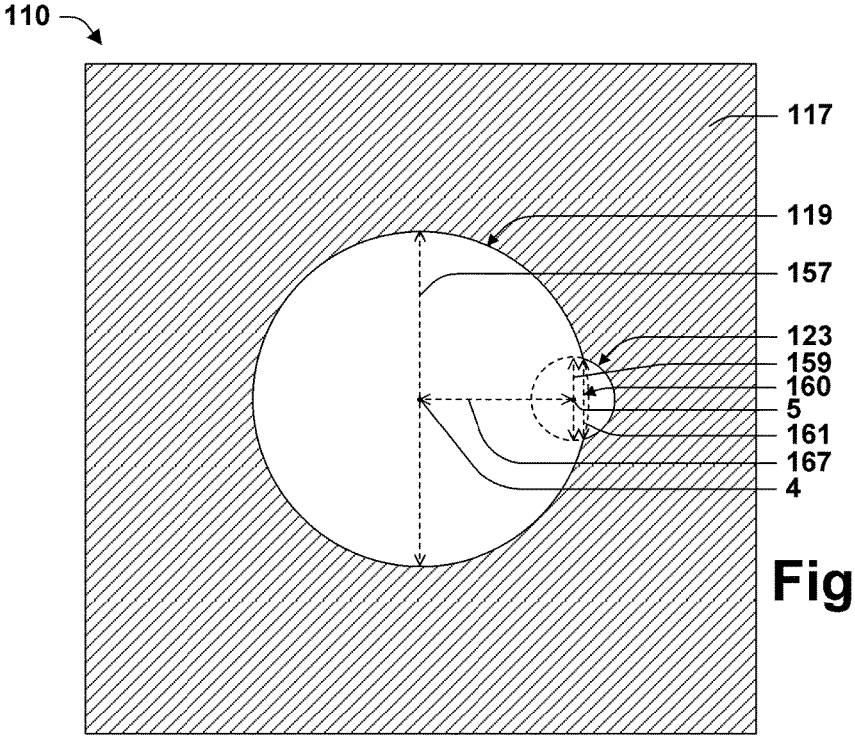
FIG. 8 illustrates the partial cross-section of FIG. 5 with the lifter removed.
Figure 9:
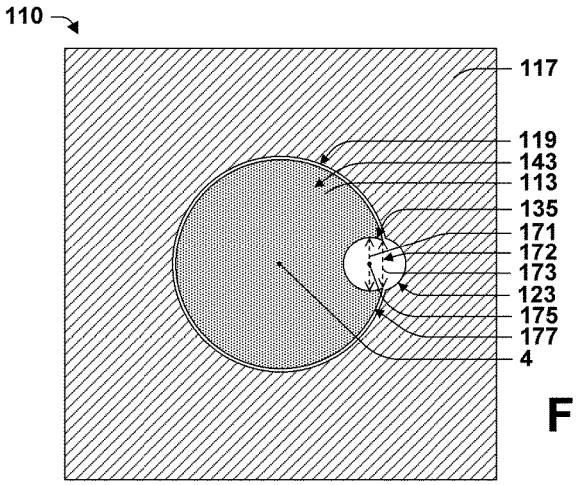
FIG. 9 illustrates the partial cross-section of FIG. 5 with the anti-rotation guide removed.

FIGS. 5-7 illustrate partial cross-sections of engine 110 along lines 2-2, 1-1, and 3-3 of FIG. 2 respectively. These lines and their positioning with respect to lifter 113 are also shown in FIG. 4. FIG. 8 shows the partial cross-section of engine 110 along the line 2-2 with lifter 113 removed. FIG. 9 shows the partial cross-section of engine 110 along the line 2-2 with just anti-rotation guide 125 removed.

According to some aspects of the present teachings, a channel 123 is formed in cylinder head 117 and adjoining bore 119, whereby there is an opening 160 of width 161 between channel 123 and bore 119 (see FIG. 8). Channel 123 may be a cylindrical bore having a diameter 159 and an axis 5. Bore 119 may be a cylindrical bore having a diameter 157 and an axis 4. The axes 4 and 5 may be parallel and separated by a distance 167. Distance 167 may be less than half the sum of diameter 157 and diameter 159, whereby the two bores overlap. In some of these teachings, channel 123 is the smaller bore and is formed first. In some of these teachings, channel 123 extends only part way through cylinder head 117. Channel 123 extends sufficiently through cylinder head 117 to allow free movement of anti-rotation guide 125 throughout the range of motion induced by rotation of cam 131. In some of these teaching, channel 123 is further extended to allow lifter 113 to be raised beyond the lift of cam 131 to facilitate assembly of engine 110. In some of these teachings, channel 123 is sufficiently long to allow lifter 113, apart from cam follower 127, to be raised to the height of surface 133 at its intersection with bore 119.

Cylindrical portion 143 of lifter 113 may have a diameter 122 nearly equal to but slightly less than the diameter 157 of bore 119 (see FIGS. 3 and 8). In some of these teachings, the width 161 of the opening 160 between channel 123 and bore 119 is less than the diameter 122 of lifter 113. In some of these teachings, width 161 is half or less diameter 122. These dimensions may enhance the performance of anti-rotation guide 125.

According to some aspects of the present teachings, a channel 135 having a width 171 is formed in cylindrical portion 143 of lifter 113 (see FIG. 9). Channel 135 may be a cylindrical bore having diameter 171. Channel 135 may have an axis 175 that is parallel to axis 4 of bore 119. Channel 135 overlaps an edge 177 of cylindrical portion 143 of lifter 113 to form an opening 172 of width 173.

According to some aspects of the present teachings, anti-rotation guide 125 has a substantially constant profile through a significant portion of its length when viewed along axis 4. A significant portion is, for example, one fourth or more and could be the majority of the length. In some of these teachings, the profile includes a first region 150 having width 145 and a second region 148 of width 146 (see FIG. 5). Regions 148 and 150 may be lobes and may be joined through a neck region 149 of width 147. In some of these teachings, the width 147 of neck region 149 is less than the width 145 of first region 150. The width 147 of neck region 149 may also be less than the width 146 of second regions 148.

According to some aspects of the present teachings, first region 150 of anti-rotation guide 125 is mounted within channel 135. First region 150 of anti-rotation guide 125 may fit within and substantially plug a portion of the length of channel 135. Because anti-rotation guide 125 may largely fill a length of channel 135 and, to a lesser extent, a length of channel 123, anti-rotation guide 125 may be described as a plug. According to some aspects of the present teachings, width 145 of first region 150 is greater than the width 173 of opening 172 (see FIGS. 5 and 9), whereby first region 150 cannot slip out of channel 135 through opening 172. The width 145 of first region 150 may be nearly equal the diameter 171 of channel 135. According to these teachings, the diameter 171 of channel 135 is also greater than the width 173 of opening 172.

According to some aspects of the present teachings, second region 148 of anti-rotation guide 125 is mounted to reciprocate within channel 123. Neck region 149 of anti-rotation guide 125 may pass through opening 160 between bores 119 and 123 to join first region 150 and second region 148 of anti-rotation guide 125 (see FIGS. 5 and 8). Accordingly, the width 147 of neck region 149 may be less than the width 161 of opening 160.

In some of these teachings, the width 161 of opening 160 is less than the width 171 of channel 135 in lifter 113. In some of these teachings, first region 150 of anti-rotation guide 125 has a width 145 that is greater than the width 161 of opening 160. In some of these teachings, first region 150 is sufficiently wide to form an interference fit with channel 135. These characteristic may relate to enhanced functioning of anti-rotation guide 125.

According to some aspects of the present teachings, with first region 150 of anti-rotation guide 125 mounted within channel 135 of lifter 113, second region 148 of anti-rotation guide can extend out of bore 119 and into channel 123 formed in cylinder head 117, provided that lifter 113 has a suitable orientation with respect to cylinder head 117. The relative shapes of second region 148 and channel 123 limit rotation of lifter 113. In some of these teachings, second region 148 is shaped to permit lifter 113 to rotate several degrees while remaining within the confines of channel 123. It has been determined that a degree of freedom to rotate does not interfere with the performance of a roller follower 127. Allowing this degree of freedom increases manufacturing tolerances for the engine 110.

According to some aspects of the present teachings, channel 135 in cylindrical portion 143 of lifter 113 is formed only partway through cylindrical portion 143, whereby channel 135 terminates within cylindrical portion 143 to form an end surface 124 (see FIG. 3). In some of these teachings, channel 135 is formed in cylindrical portion 143 from end 140 and surface 124 is the distal end of channel 135. Channel 135 may be formed in any suitable manner, such as drilling or milling. In some of these teaching, channel 135 is formed by milling, which allow surface 124 to be relatively flat. Relatively flat may be understood as being flatter than a typical surface formed by drilling, which would be no flatter than a 135 degree cone. Making surface 124 relatively flat facilitates fixedly mounting anti-rotation guide 125 in channel 135.

Figure 10:
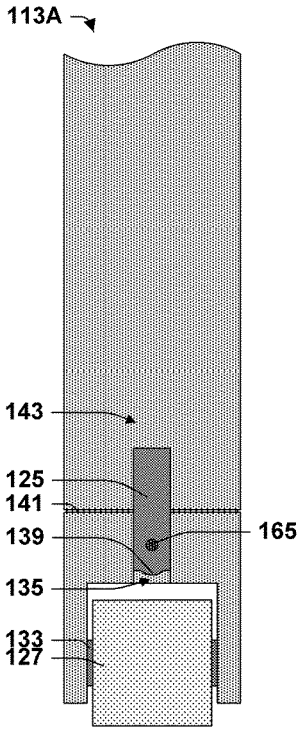
FIG. 10 illustrates a front view of the lower portion of a lifter according to some other aspects of the present teachings.

In some aspects of the present teachings, first region 150 of anti-rotation guide 125 is retained within channel 135 in lifter 113. First region 150 of anti-rotation guide 125 may be retained within channel 135 in any suitable manner. In some of these teachings, of which lifter 113A of FIG. 10 provides an example, first region 150 is retained within channel 135 by a set screw 165 threaded through anti-rotation guide 125. In some of these teachings, for which lifter 113 provides an example, first region 150 is retained within channel 135 by a C-clip 137. In some of these teachings, C-clip 137 is positioned to press against end 126 of anti-rotation guide 125, whereby anti-rotation guide 125 may be clamped between C-clip 137 and bore end surface 124 (see FIG. 3). In some of these teachings, a groove 151 is provided about the periphery of channel 135 to receive and retain C-clip 137. In some of these teachings, anti-rotation guide 125 has a bulge 139 (see FIGS. 3 and 6). Bulge 139 may protrude between open ends 153 of C-clip 137 and limit rotation of C-clip 137.

Anti-rotation guide 125 may be formed in any suitable fashion. In some aspects of the present teachings, anti-rotation guide 125 is cold-formed. Anti-rotation guide 125 may be cold-formed from a cylindrical slug of metal. Cold-forming may include a series of stamping operations. A mold for one or more of these operations may include an opening through which a bulge 139 forms.

In some of these teachings, a groove 141 is formed in the periphery of cylindrical portion 143 of lifter 113 (see FIG. 3). Lifter 113 may have a range of motion within bore 119. The range may be determined by the shape of cam 127. In some of these teachings, an oil rifle 121 letting out onto bore 119 is formed in cylinder head 117 (see FIGS. 1 and 2). In some of these teachings, groove 141 remains separated from oil rifle 121 throughout the range of motion of lifter 113. For example, oil rifle 121 may remain above groove 141 through lifter 113's range of motion. This configuration may facilitate maintaining good lubrication while avoiding excessive oil consumption.

Figure 11:
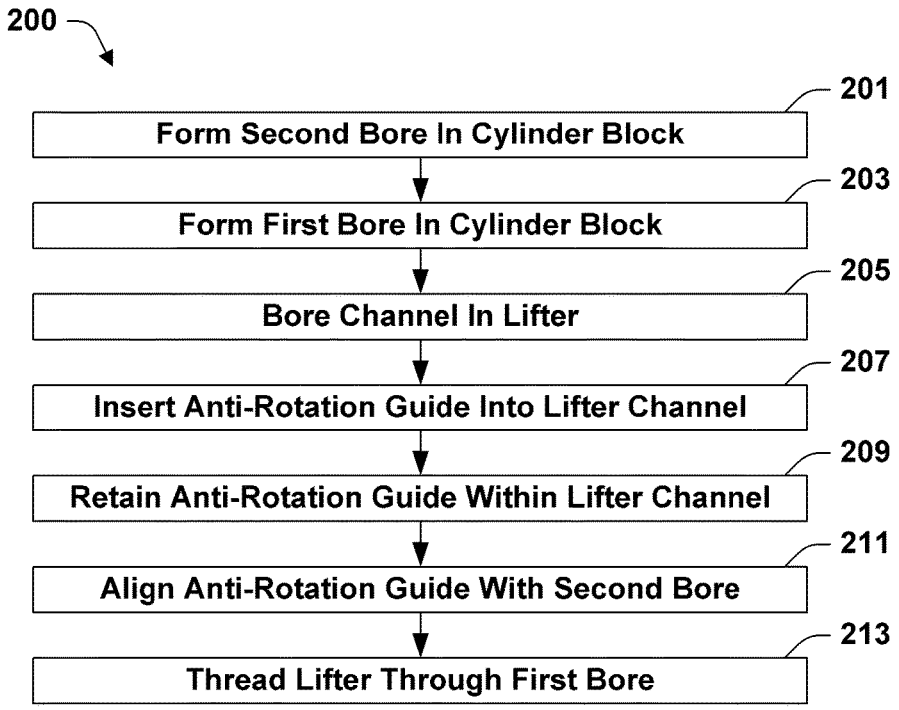
FIG. 11 is a flow chart of a method according to some aspects of the present teachings.

FIG. 11 provides a flow chart of a method 200 according to some aspects of the present teachings. Method 200 includes act 201, forming channel 123 in cylinder block 117 and act 203, forming bore 119 in cylinder block 117. In some of these teachings, channel 123 is formed before bore 119. In some of these teaching, channel 123 is formed only part way through cylinder block 117. In some of these teachings, formation of channel 123 and bore 119 is initiated from lower surface 133 of cylinder block 117.

Method 200 further includes act 205, boring channel 135 in lifter 113. In some of these teachings, channel 135 is formed by milling. Act 207 is inserting anti-rotation guide 125 into channel 135. Act 209 is retaining anti-rotation guide 125 within channel 135. In some of these teachings, act 209 is installing C-clip 137. In some of these teaching, act 209 is tightening set screw 165.

Method 200 continues with act 211, aligning lifter 113 with bore 119 while aligning second region 148 of anti-rotation guide 125 with channel 123. Act 211 enables subsequent act 213, threading lifter 113 through cylinder block 117, which is part of the process of installing rocker arm assembly 112 in engine 110. Anti-rotation guide 125 may then maintain proper orientation of cam follower 127 with respect to cam 131.

The components and features of the present disclosure have been shown and/or described in terms of certain teachings and examples. While a particular component or feature, or a broad or narrow formulation of that component or feature, may have been described in relation to only some aspects of the present teachings or examples, all components and features in either their broad or narrow formulations may be combined with other components or features to the extent such combinations would be recognized as logical by one of ordinary skill in the art.

The invention claimed is:

1. A valvetrain comprising:

a lifter having a lifter axis along which the lifter is shaped to reciprocate;

a bore that is formed in the lifter, the bore having a cylinder-conforming perimeter the axis of which is parallel to the lifter axis, the perimeter of the bore intersecting an edge of the lifter to form an opening in the edge of the lifter;

an anti-rotation guide mounted to the lifter and retained within the bore;

wherein the anti-rotation guide maintains a uniform profile over a portion of its length in a direction parallel to the lifter axis;

the profile includes a first region and a second region joined by a neck region;

the first region is wider than the neck region;

the first region is within the lifter; and the second region extends via the neck region outward from the lifter through the opening in the edge of the lifter.

2. A method of forming a valvetrain according to claim 1, comprising:

forming a bore in the lifter;

inserting a portion of the anti-rotation guide comprising the first region into the bore; and retaining the anti-rotation guide within the bore.

3. The method of claim 2, further comprising cold forming the anti-rotation guide from a slug of metal.

4. The method of claim 3 wherein:

cold forming produces a bulge at one end of the anti-rotation guide;

retaining the anti-rotation guide within the bore comprises installing a C-clip partially into a groove formed in the lifter; and the bulge restricts rotation of the C-clip.

5. The valvetrain of claim 1, wherein considered along the direction of the axis of the bore in the lifter, the bore has a first end that is open and a second end that terminates within the lifter.

6. An engine comprising:

a cylinder head in which first and second bores are formed, wherein the first and second bores are parallel and overlap to form an opening between them;

a valvetrain comprising a lifter, wherein the lifter comprises a cylindrical portion having an axis and is threaded through the first bore;

a bore formed in the lifter, wherein the bore in the lifter has a cylinder-conforming perimeter the axis or which is parallel to that of the cylindrical portion, and the perimeter of the bore intersects an edge of the cylindrical portion to form an opening in the perimeter of the lifter; and a plug in the bore in the lifter having a protrusion extending through the opening in the edge of the lifter;

wherein the protrusion is positioned to reciprocate within the second bore in the cylinder head.

7. The engine of claim 6, wherein the opening in the edge of the lifter has a width less than a width of the bore in the lifter.

8. The engine of claim 6, wherein the portion of the plug that is in the lifter has a greater width than the opening in the edge of the lifter.

9. The engine of claim 6, wherein the cylindrical portion of the lifter has a diameter greater than the width of the opening between the bores in the cylinder head.

10. The engine of claim 6, wherein the plug is retained in the bore in the lifter by a C-clip.

11. The engine of claim 10, wherein the C-clip is held within a groove in the lifter that is formed about the perimeter of the bore in the lifter.

12. The engine of claim 10, wherein the bore in the lifter has an end that terminates within the cylindrical portion of the lifter to form a relatively flat end surface.

13. The engine of claim 10, wherein the C-clip presses against one end of the plug.

14. The engine of claim 13, wherein the plug has a bulge that extends outward between two ends of the C-clip.

15. The engine of claim 14, wherein the bulge has a shape produced by cold-forming the plug.

16. The engine of claim 6, wherein the plug is held to the lifter by a set screw threaded through the plug.

17. The engine of claim 6, wherein the cylindrical portion of the lifter has a groove formed about its perimeter.

18. The engine of claim 17, wherein:

an oil rifle is formed in the cylinder head;

the oil rifle opens onto the first bore in the cylinder head;

the lifter has a range of motion within the first bore;

the groove formed about the perimeter of the cylindrical portion of the lifter remains separated from the oil rifle throughout the lifter's range of motion within the first bore.

19. The engine of claim 6, wherein:

a roller follower is mounted at one end of the cylindrical portion of the lifter;

the bore in the cylindrical portion of the lifter is formed through the end of the cylindrical portion on which the roller follower is mounted.

20. A method of forming the engine of claim 6, comprising:

forming the second bore in the cylinder head;

then forming the first bore in the cylinder head; and inserting the lifter with the anti-rotation guide attached through the first bore with the anti-rotation guide entering the second bore.

* * * * *